US011103876B2

(12) United States Patent
Conway

(10) Patent No.: US 11,103,876 B2
(45) Date of Patent: Aug. 31, 2021

(54) INCINERATOR ASH WET PROCESSING

(71) Applicant: Best Process Solutions, Inc., Brunswick, OH (US)

(72) Inventor: Timothy F. Conway, Hinckley, OH (US)

(73) Assignee: BEST PROCESS SOLUTIONS, INC., Brunswick, OH (US)

( * ) Notice: Subject to any disclaimer, the term of this patent is extended or adjusted under 35 U.S.C. 154(b) by 185 days.

(21) Appl. No.: 15/652,599

(22) Filed: Jul. 18, 2017

(65) Prior Publication Data

US 2019/0022662 A1 Jan. 24, 2019

(51) Int. Cl.

| | |
|---|---|
| ***B02C 23/38*** | (2006.01) |
| ***B02C 23/18*** | (2006.01) |
| ***B03B 9/04*** | (2006.01) |
| ***B02C 21/00*** | (2006.01) |
| ***B02C 23/10*** | (2006.01) |
| ***B02C 23/14*** | (2006.01) |

(52) U.S. Cl.

CPC ..... *B02C 23/38* (2013.01); *B02C 21/00* (2013.01); *B02C 21/007* (2013.01); *B02C 23/10* (2013.01); *B02C 23/14* (2013.01); *B02C 23/18* (2013.01); *B03B 9/04* (2013.01)

(58) Field of Classification Search

CPC ..... B02C 21/00; B02C 17/14; B02C 17/20; B02C 23/14; B02C 23/38; B02C 13/18; B02C 13/14; B02C 13/38

USPC ..... 241/46.01, 46.08, 46.17, 152.1, 286

See application file for complete search history.

(56) References Cited

U.S. PATENT DOCUMENTS 2,513,413 A * 7/1950 Huszar ..... B02C 17/18 241/171
2,613,036 A * 10/1952 Robinson ..... B02C 17/14 241/175
2,877,954 A * 3/1959 Myers ..... B02C 21/00 241/24.13
2,965,316 A 12/1960 Henderson et al.

(Continued)

FOREIGN PATENT DOCUMENTS

| | | |
|---|---|---|
| DE | 198 52 139 A1 | 5/2000 |
| EP | 0 997 202 A2 | 5/2000 |
| GB | 1513511 | 6/1978 |

OTHER PUBLICATIONS

"Recycling of a fine, heavy fluff automobile shredder residue by density and differential fragmentation", M. R. Gent et al., Waste Management 43 (2015) pp. 421-433, Available online Jun. 25, 2015.

(Continued)

*Primary Examiner* — Ghassem Alie
*Assistant Examiner* — Nhat Chieu Q Do
(74) *Attorney, Agent, or Firm* — Pearne & Gordon LLP

(57) ABSTRACT

A system and process for reclaiming metals from bottom ash material comprising a pair of rod mills each having an inlet for receiving material and an outlet for discharging material, the outlet of a first rod mill being connected to the inlet of a second rod mill, said rod mills for inclination and power, a circuit for water flow through the rod mills for flushing crushed material and metal from the rod mills to a screen where metal is separated from minerals and water and a processing device for separating minerals from the water of the screen separated minerals and water.

6 Claims, 1 Drawing Sheet

(56) References Cited

U.S. PATENT DOCUMENTS 3,022,017 A * 2/1962 McKenna ..... B02C 17/04 241/183
3,027,105 A * 3/1962 Hall ..... B02C 17/20 241/184
3,124,314 A * 3/1964 Klein ..... B02C 17/20 241/172
3,373,944 A * 3/1968 Fegan, Jr. ..... B02C 25/00 241/15
3,727,849 A * 4/1973 Kjos ..... B03B 7/00 241/4
3,933,316 A * 1/1976 Jones ..... B02C 4/00 241/170
4,148,440 A * 4/1979 Eisenhauer ..... B23K 35/404 241/175
4,667,887 A * 5/1987 Kawaguchi ..... B02C 25/00 241/20
4,753,660 A * 6/1988 Kellerwessel ..... C10L 1/326 241/16
5,316,746 A * 5/1994 Narita ..... C01G 49/0036 423/151
5,427,607 A * 6/1995 Cristovici ..... C22B 7/04 241/14
5,925,862 A * 7/1999 Morrisey, IV ..... C22B 23/00 209/164
6,402,064 B1 * 6/2002 Tango ..... B03B 9/00 241/21
7,681,818 B2 * 3/2010 Peterson ..... A23G 1/12 241/153
2009/0283018 A1 * 11/2009 Grasso, Jr. ..... B02C 17/22 106/709
2016/0369371 A1 12/2016 Conway

OTHER PUBLICATIONS

International Search Report and Written Opinion of the International Searching Authority, or the Declaration dated Sep. 21, 2018 of PCT/US2018/041201, filed Jul. 9, 2018.

* cited by examiner

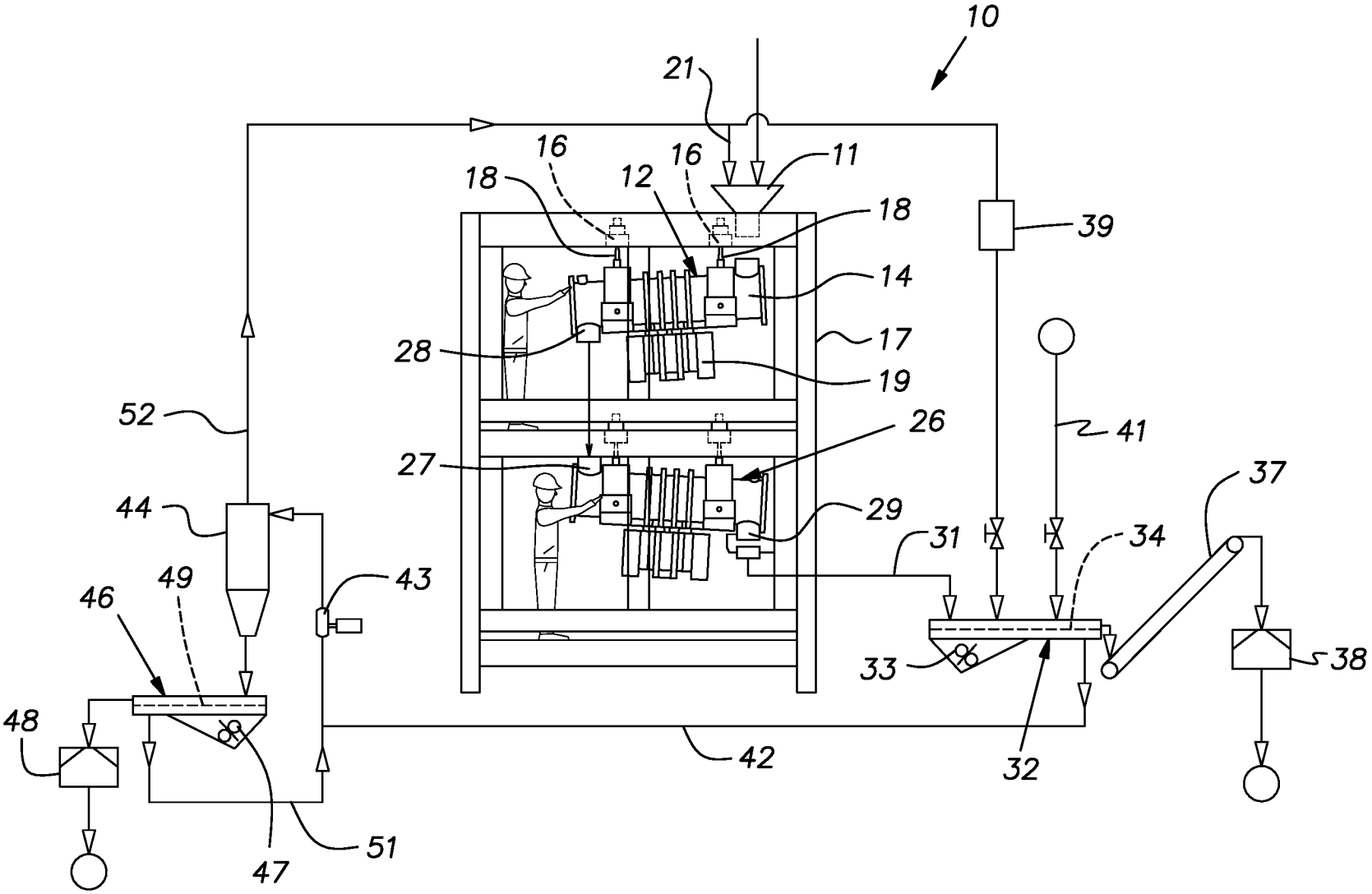
10
11
12
14
16
16
17
18
18
19
21
26
27
28
29
31
32
33
34
37
38
39
41
42
43
44
46
47
48
49
51
52

INCINERATOR ASH WET PROCESSING

BACKGROUND OF THE INVENTION

The invention relates to recovery of metals from incinerator bottom ash.

PRIOR ART

Municipal waste has long been incinerated to reduce its bulk. Ordinarily, the bottom ash produced in the incineration process is disposed of by burying it in a landfill. UK Patent 1/513,511 mentions a percussion crusher shredder being limited to recovery of only ferrous scrap and proposes an alternative wet process for recovering metals from incinerated urban refuse. The disclosed process, apparently, has not met with widespread commercial success.

Millions of tons of bottom ash continues to go to landfills without recovery of the ash metal content in the minus 12 mm fraction, i.e. the fraction of solid particles small enough to pass through 12 mm screen openings. There has long existed a need for an efficient, cost effective and reliable system for recovering bottom ash metal content.

SUMMARY OF THE INVENTION

The invention obtains a recovered metal product from bottom ash that is remarkably high in metal purity, typically approaching 98 percent metal. In the disclosed wet process, bottom ash concentrate less than 12 mm is fed sequentially through a pair of independently operated rod mills. Water flowing through the rod mills effectively flushes crushed mineral particles as they are produced through the mills, thereby making the milling process especially effective and efficient.

As disclosed, the sequential rod mills are independently suspended and independently actuated. The mills, additionally, for example, can be fitted with bars of different diameter and different number. By varying the operating conditions of each mill separately, the overall performance of a system can be optimized for bottom ash from different sources and of different grades.

BRIEF DESCRIPTION OF THE DRAWING

The FIGURE is a schematic representation of a metal recovery system embodying the invention.

DESCRIPTION OF THE PREFERRED EMBODIMENT

An exemplary system 10 and wet process for recovering metals from bottom ash embodying the invention is schematically shown in the FIGURE.

Incinerator bottom ash typically is fed to an inlet 11 of a first rod mill 12. The rod mill, by way of example, can be a cylindrical steel housing of steel sheet with an outside diameter of 24 inches and a length of 6 foot. Steel rods of varying diameter of, for example, ½ to 1½ inch and slightly less in length than the length of the housing interior can be loaded in the housing to occupy some fraction of the housing volume. For example, ⅓ to ½ of the interior housing space can be filled, in a bulk sense, with rods. The rod mill housing 14 is suspended with springs 16 carried in a frame 17. The springs 16 are spaced along the length of the housing 14 and are connected to the housing with support rods 18 of adjustable effective lengths. By adjusting the effective length of the support rods, the inclination of the housing 14 is adjusted. An electric motor 19 fixed on the housing 14 spins an eccentric mass to oscillate the housing about a longitudinal axis with high levels of acceleration. Oscillation of the housing 14 causes rotational displacement of rods within the housing. Rod motion crushes friable components of material introduced to the rod mill 12.

Process water circulating in the system 10 is fed through a line 21 into the rod mill inlet 11 simultaneously with the municipal incinerator bottom ash or the like.

A second rod mill 26 has the same general construction, suspension and vibration inducing motor as that of the first rod mill 12. An inlet 27 of the second rod mill 26 is connected to an outlet 28, preferably directly, of the first rod mill 12 so that material flow through the mills 12 and 26 is serial and no substantive treatment of material passing between the mills is performed.

The rod mills 12, 26 operate to crush friable material including glass, ceramics, rock and minerals contained in ash to small particles, preferably of 1 millimeter or less. The process water flushes the smaller crushed particles through the rod mills 12, 26 as they are produced, thereby exposing the remaining crushable material to the crushing action of the mill rods thus improving throughput of ash material. Metal fragments, being less friable than other components in the ash, pass through the rod mills 12, 26 for the most part without fracturing into small particles.

An outlet 29 of the second mill 26 is connected to a conduit 31 that delivers material to a vibrating screen unit 32 operated by a vibrating motor 33. A screen 34 with openings of between 0.5 mm and 2.5 mm and preferably between 1 mm and 2 mm, for example, conveys metal particles of a size greater than 1 mm, for example, to a discharge conveyor 37 which deposits the metals in a collection site represented by a bin 38.

The recovered metal travelling on the vibrating screen 34 is first rinsed with process water filtered at a filtering system represented at 39. The filtering system can be any suitable commercially available water filter unit. The recovered metal on the screen 34 is thereafter rinsed or flushed with fresh water supplied from a line 41. This second rinse with clean, chemically neutral water, flushes the highly caustic process water off the metals on the screen 34 to avoid subsequent extended oxidation of the metals, particularly aluminum which would otherwise occur if the process water remained to dry on the metals. Process water and suspended mineral particulates passing through the screen 34 are collected and carried off by a line 42 feeding the inlet of a process pump 43. The process pump 43 supplies water with suspended minerals to the inlet of a hydrocyclone 44. Minerals and like solids descending through the hydrocyclone are directed to a vibrating screen unit 46 operated by a vibratory motor 47. The vibratory screen 46, with openings of between 0.25 mm and 3 mm and preferably between 0.25 mm and 1 mm, for example, separates the minerals from water discharged from the bottom of the hydrocyclone 44 and transmits them to a collection area represented by a bin 48. Water passed through a screen 49 of the vibrating unit 46 is conducted to the process pump 43 through a line 51. Water flowing out of the top of the hydrocyclone 44 with a reduced mineral content is supplied through a line 52 to the first rod mill inlet 11 as process water.

The system and process of the invention has demonstrated surprising results measured by high throughput capacity, high purity of recovered metals, low energy consumption, low fresh water consumption, low maintenance and high reliability. A large factor in the surprisingly high performance of the system is believed to be the series arrangement of the separately operated rod mills 12, 26. The rod mills 12, 26 can be independently operated, for example, at different power levels by adjusting motor speed and/or eccentricity of a rotating mass, at different inclinations or declinations with different bar size diameters and with a different number of bars. These variables can be adjusted for the actual composition of the bottom ash being wet processed at any given time.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A wet process for recovering metal from bottom ash comprising feeding ash and water into an inlet of a first oscillating rod mill where some of the friable mineral content of the ash is crushed by elongated rods in a housing and the water serves to flush the crushed mineral and non-crushed metal particle content through an outlet of the first oscillating rod mill into an inlet of a second oscillating rod mill of elongated rods in a housing, operating the second oscillating rod mill with a power level and a housing inclination independent of and different from the power level and housing inclination at which the first oscillating rod mill is operated to further crush material received from the first oscillating rod mill to produce friable mineral particles of 1 mm or less in size while not crushing metal particles, allowing the water to flush the crushed minerals and non-crushed metal particles through an outlet of the second oscillating rod mill, separating non-crushed metal particles from the crushed minerals and water from the second oscillating rod mill outlet with a screen, separating the crushed minerals from water after separation of the non-crushed metal particles, returning the water, as process water from which crushed minerals have been separated, to the inlet of the first oscillating rod mill, and wherein each of the first and second oscillating rod mill housings has an electric motor to spin an eccentric mass fixed to a respective housing to respectively oscillate the housing about a longitudinal axis with high levels of acceleration.

2. A process as set forth in claim 1, wherein the process water is filtered and after filtering is used to rinse the metals being separated on said metal separating screen.

3. A process as set forth in claim 2, wherein the metals, after being rinsed by filtered process water are rinsed with fresh water of a pH of about 7 to reduce oxidation of the metals.

4. A process as set forth in claim 1, wherein the crushed minerals are separated from the water after separation of the metal, with a hydrocyclone.

5. A process as set forth in claim 4, wherein the minerals and water discharged from the hydrocyclone are separated with a fine screen.

6. A process as set forth in claim 5, wherein the fine screen has a receiving area vibrated to remove the minerals to a discharge station and remove the water from said minerals.

* * * * *